US005375381A

United States Patent [19]

Park et al.

[11] Patent Number: 5,375,381

[45] Date of Patent: Dec. 27, 1994

[54] BUILDING KIT

[75] Inventors: Owen H. Park; Stephen J. Campbell, both of Carmel, Ind.

[73] Assignee: Heartland Industries, Inc., Carmel, Ind.

[21] Appl. No.: 23,109

[22] Filed: Feb. 26, 1993

[51] Int. Cl.[5] ..... E04B 7/02

[52] U.S. Cl. ..... 52/92.1; 52/93.1; 52/92.3; 411/106; 411/479

[58] Field of Search ..... 52/90.1, 92.1, 92.2, 52/92.3, 93.1, 93.2; 446/106, 112, 479

[56] References Cited

U.S. PATENT DOCUMENTS

| | | | |
|---|---|---|---|
| 788,445 | 4/1905 | White | 52/92.3 |
| 1,261,173 | 4/1918 | Stadelman | 52/92.1 |
| 2,300,784 | 11/1942 | Hasenburger et al. | 52/92.2 |
| 2,412,242 | 12/1946 | Beaud | 52/92.2 |
| 2,495,966 | 1/1950 | Haines . | |
| 2,880,470 | 4/1959 | Pickersgill . | |
| 2,902,733 | 9/1959 | Justus . | |
| 3,082,492 | 3/1963 | Grubb . | |
| 3,206,903 | 9/1965 | Johnson | 52/92.1 |
| 3,360,892 | 1/1968 | Rosso | 52/93.1 |
| 3,477,184 | 11/1969 | Johnson et al. . | |
| 4,069,627 | 1/1978 | Pegg | 52/93.1 |
| 4,115,967 | 9/1978 | Kragt . | |
| 4,481,744 | 11/1984 | Park | 52/92.1 |
| 4,527,981 | 7/1985 | Chisum . | |
| 4,573,293 | 3/1986 | Park | 52/92.1 |
| 4,701,131 | 10/1987 | Hildebrandt et al. . | |
| 4,756,127 | 7/1988 | Helterbrand et al. | 52/93.1 |
| 4,894,963 | 1/1990 | Campbell . | |

*Primary Examiner*—Carl D. Friedman
*Assistant Examiner*—Winnie Yip
*Attorney, Agent, or Firm*—Barnes & Thornburg

[57] ABSTRACT

A kit for the assembly of a building structure has a plurality of side walls, a floor, and a roof. The kit comprises a plurality of precut building members, each building member having end portions configured to abut adjacent building members to form a building structure, each building member having a predetermined location relative to the remaining building members in the building structure. The kit also comprises means for properly positioning predetermined building members relative to one another, the positioning means having first and second members. The first member is prefabricated to include a lip for partially overlapping a side wall and a bevelled edge. The plurality of building members may include a plurality of precut studs and rafters and the first member further may comprise a plurality of notches in spaced-apart relation, the notches being sized to permit the insertion of the studs therein.

8 Claims, 2 Drawing Sheets

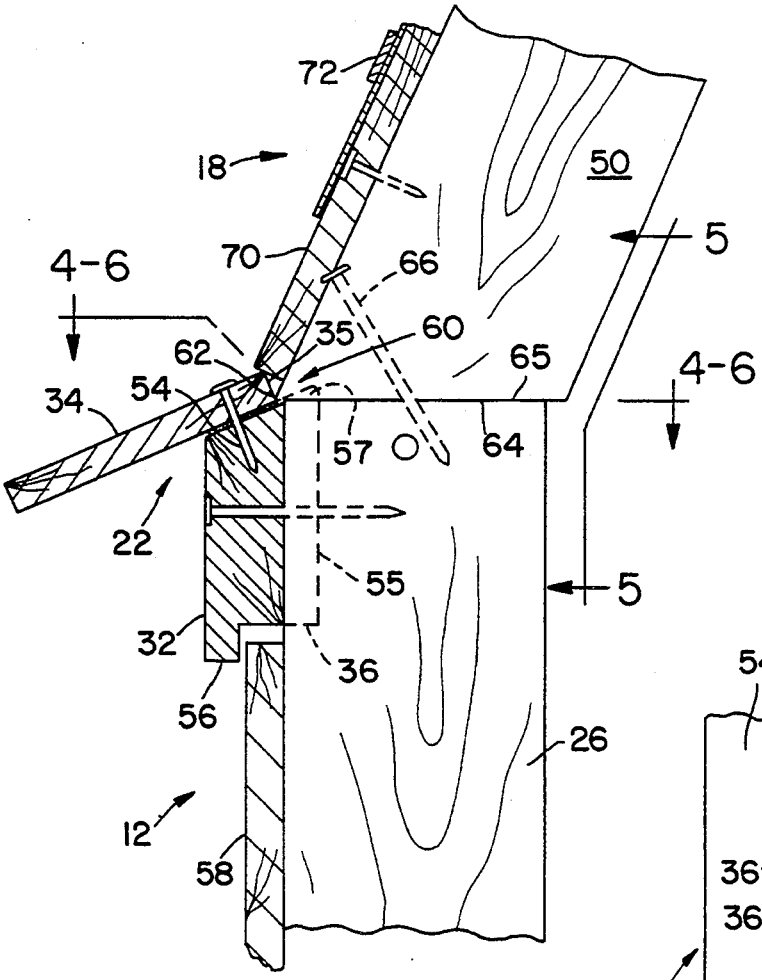
FIG. 3
FIG. 4
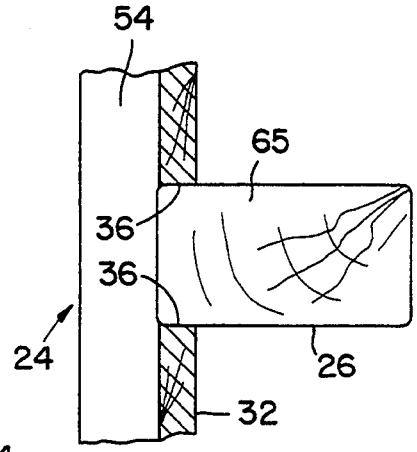
FIG. 5
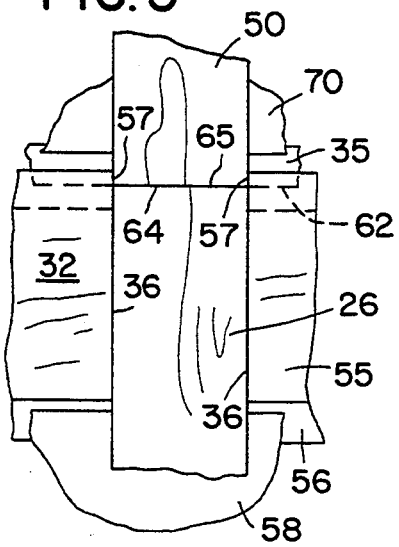
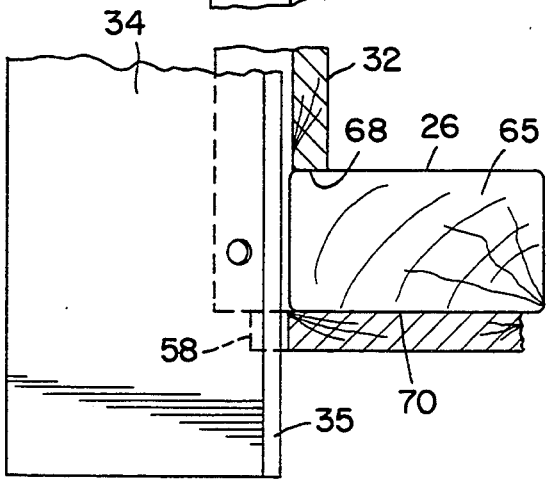
FIG. 6

BUILDING KIT

BACKGROUND AND SUMMARY OF THE INVENTION

The present invention relates to building structures, and particularly to pre-cut, ready to assemble buildings. More particularly, the present invention relates to buildings having portions thereof prefabricated to reduce waste and facilitate construction.

Conventional building assemblies include a plurality of building members of various shapes and sizes. Assembly of these conventional buildings can be difficult, especially to an individual who is not experienced in assembling a building. Because different building members have shapes and sizes that can be confusingly similar, it can be extremely time consuming to assemble the building according to a predetermined specification. A method for marking the building members so that selected building members to be interconnected can be determined by visual inspection would facilitate assembly of a building.

Coded indicia for use on the building members for indicating the predetermined position of each building member is known. See, for example, U.S. Pat. No. 4,894,963 to Campbell, the disclosure of which is incorporated herein by reference.

While the use of coded indicia facilitates the positioning of building members in their predetermined locations relative to each other, their use has been limited to indicating that certain building members abut, or are adjacent to, certain other building members. The coded indicia do not eliminate the need for accurate measuring and marking of the building members by the builder to ensure accurate placement. The builder must measure and mark the certain building members to determine the exact location of abutting or adjacent members so that predetermined building members, such as studs and rafters, are properly positioned and aligned. A mechanism that would facilitate the construction of a building by reducing or eliminating the need for measuring and marking positions on various building members would provide an improvement over conventional building assemblies. Such a mechanisms would reduce the likelihood of mistakes, and therefore waste, and reduce the skill level required of the assembler of the building.

According to the present invention, a kit for the assembly of a building structure includes a plurality of precut studs and rafters and precut panels for use as side walls, a floor, and a roof. The kit also includes a prefabricated "magic rail" for properly positioning the studs and rafters relative to one another.

The "magic rail" includes a first member having a plurality of notches for properly locating stud members in parallel spaced-apart relation to one another. A second member is attached to the first member so as to form a ridge for positioning the rafter members relative to the stud members. Thus, when the stud members are properly positioned in the "magic rail", the stud members are properly aligned and the rafters are properly positioned relative to the floor.

According to one aspect of the invention, the second member is positioned at an angle to the first member to provide a hip in the roof structure that partially overhangs at least one of the side walls. According to another aspect of the invention, coded indicia are located on the end portions of the building members for indicating a predetermined location of the building members to facilitate the assembly of the kit. In preferred embodiments of the invention, the coded indicia include color coding indicia.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 3 is a sectional view showing the magic rail at the hip joint of the building in relation to a stud and a rafter FIG. 4 is a sectional view taken along lines 4—4 in FIG. 3;

FIG. 5 is a sectional view taken along lines 5—5 in FIG. 3; and

FIG. 6 is a plan view of the corner structure of the building showing the second member positioned relative to the first member to form a ridge for locating a rafter relative to a stud and a portion of the magic rail overhanging the front wall of the building.

DETAILED DESCRIPTION OF THE DRAWINGS

Figure 1:
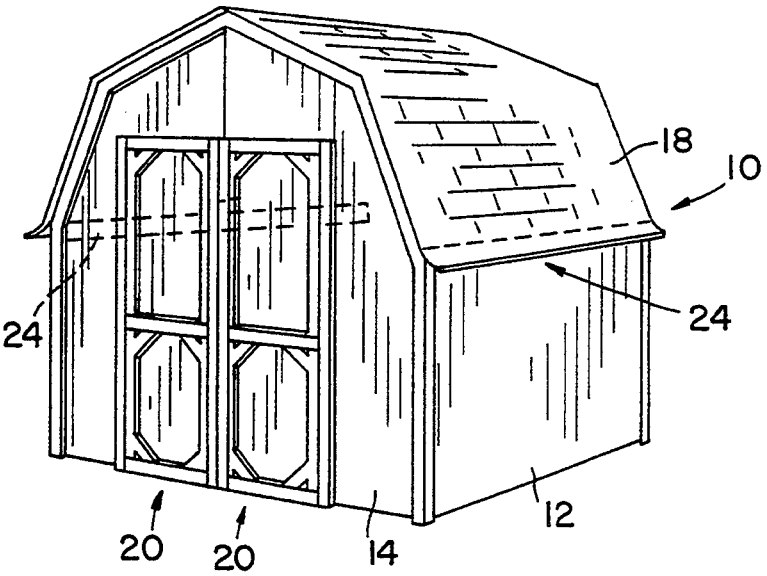
FIG. 1 is a perspective view of a completed building showing a magic rail in phantom.

A building 10 constructed from the kit of the present invention is shown in FIG. 1. The building 10 includes a pair of side walls 12, a front wall 14, and a back wall (not shown). The walls 12 and 14 rest on a floor structure 16 and support a roof structure 18. A pair of doors 20 are mounted in the front wall 14 to allow access to the interior of the building 10. A "magic rail" for facilitating the construction of the building is shown positioned along a roof hip in dotted lines.

Figure 2:
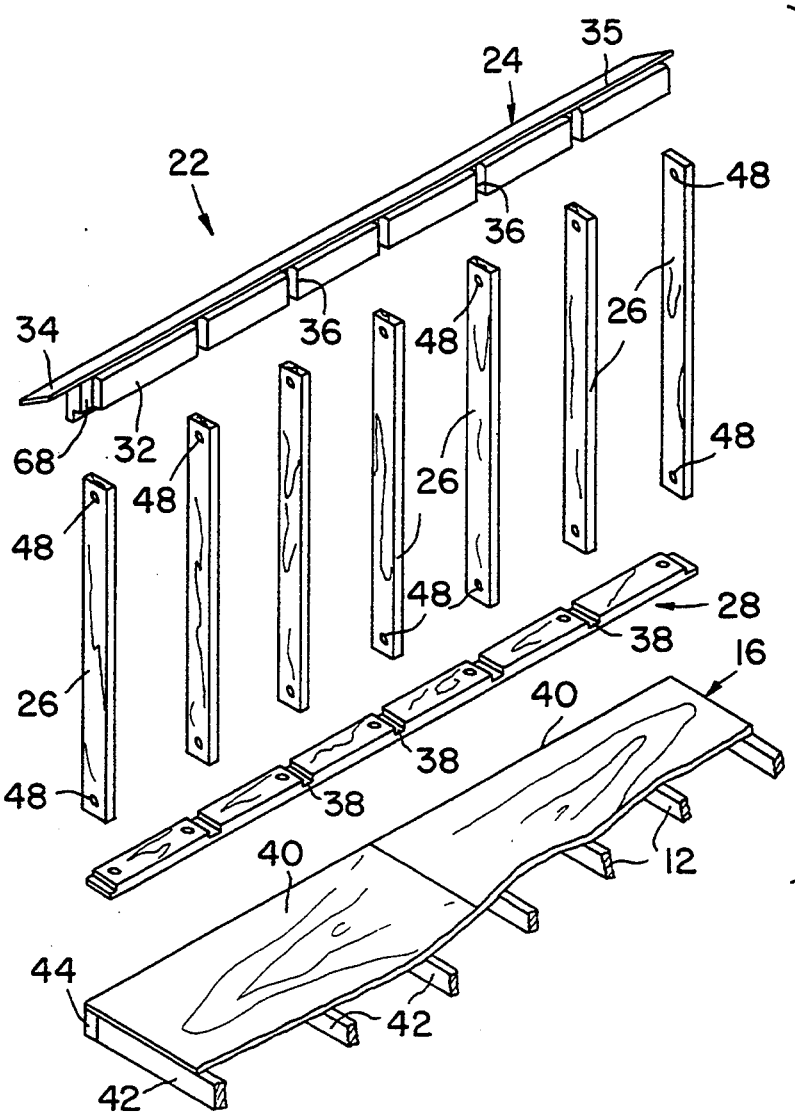
FIG. 2 is an exploded perspective view of the side wall structure of the building showing the relative positioning of the magic rail, studs, a bottom wall template, and the floor.

FIG. 2 shows an exploded view of the supporting structure 22 of a side wall 12. A supporting structure 22 includes a magic rail 24, a plurality of studs 26, and a bottom wall template 28. The magic rail 24 includes first and second members 32 and 34. Precut notches 36 are cut to a predetermined depth in the first member 32 and positioned in spaced-apart relation to each other. The width of the notches 36 is substantially equal to the thickness of the studs 26 so as to snugly fit studs 26 therein, as shown illustratively in FIG. 4. The second member 34, which supports the hip portion of the roof 18, is attached to the first member 32 so that the inboard surface 35 of the second member 34 is situated along the outboard surfaces of the studs 26 when the studs 26 are positioned in the notches 36.

The bottom wall template 28 rests on flooring sheets 40 which are supported by joists 42 and side rail 44. The bottom wall template 28 includes a plurality of precut notches 38 positioned in spaced-apart relation to each other. The notches 38 are cut to a predetermined depth and have a width substantially equal to the width of the studs 26 so as to snugly fit the studs 26 therein. When the bottom wall template 28 is properly located on the floor structure 16, the notches 38 are located in vertical registry with notches 36 formed in the magic rail 24. Advantageously, the builder need only attach the studs 26 in the notches 36 and 38 to easily and accurately position the studs 26 in parallel, spaced-apart relation to each other. Thus, the precut notches 36 and 38 eliminate the need for the builder to measure and mark anything on the magic rail 24 or the bottom wall template 28.

Coded indicia 48 are illustratively shown on the studs 26 and the bottom wall template 28 in FIG. 2. Each building member includes a coded indicia 48 located in close proximity to a mating section. The coded indicia 48 near each mated pair cooperate to define a characteristic predetermined pattern on the building members in a region surrounding each mated pair to provide a visual indication that the building members have been properly interconnected according to a predetermined specification. It will be understood that the coded indicia 48 may take any suitable form, such as, for example, color coding or geometric patterns.

FIG. 3 shows a partial section taken through a stud 26, a rafter 50, and the magic rail 24. The first member 32 of the magic rail 24 includes a bevelled edge 54 which extends longitudinally parallel to the axis of the magic rail 24 and extends transversely at an acute angle to the inboard surface 55 of the first member 32. The second member 34 is attached to the bevelled edge 54 by suitable attachment means, such as gluing or nailing so as to align a lower edge 62 of the inboard surface 35 with the juncture between the bevelled edge 54 and the notches 36. In a preferred embodiment, the second member 34 is glued and nailed to the first member 32 to provide mutually supportive rigidity and resistance to warpage. The acute angle between the bevelled edge 54 and the notch 36 determines the amount of pitch of the hip portion of the roof 18.

The stud 26 is positioned in the notch 36 so that the upper edge of the stud 26 is even with the juncture between the bevelled edge 54 and the notch 36. With the studs 26 in position, a triangular portion 57 (FIG. 3) of the first member 32 projects above the studs 26 and extends longitudinally along the first member 32 between the studs 26. The triangular portion 57 advantageously provides a positioning means for quickly and easily locating the rafters 50 over the studs 26. A lip 56 is formed on the bottom of the first member 32 of the magic rail 24. The lip 56 is offset from the notches 36 so as to allow a sheet of siding material 58 to be positioned between the lip 56 and the stud 26 when the studs 26 are positioned in the notches 36.

A rafter 50 is positioned to abut a stud 26 so that the lower edge 64 of the rafter 50 lies adjacent the top surface 56 of the stud 26 and the outboard lower corner 60 is positioned in the notch 36 and adjacent the lower edge 62 of the inboard surface 35 of the second member 34. Thus, the notches 36, the studs 26, and the second member 34 cooperate to provide means for easy and accurate placement of the rafters 50 in relation to the studs 26. Once positioned, the rafter can be fastened in positioned by use of a nail 66 or other art recognized fastening means. A roof panel 70 is attached to the rafters by nails or other recognized fastening means. Roof shingles 72 are attached to the roof panel 70 and to the second member 34 of the magic rail 24.

As shown illustratively in FIG. 5, the bottom surface 64 of the rafter 50 abuts the upper surface 65 of the stud 26, with the rafter 50 being positioned in the notch 36. The lower edge 62 of the inboard surface 35 of the second member 34 lies in the plane of abuttment of the rafter 50 and the stud 26. Thus, the rafter 50 can be easily and accurately positioned by abutting surfaces 64 and 65 and sliding the rafter 50, in the notch 36, until it contacts the second member 34. The sheet of siding material 58 is also shown in FIG. 5 positioned between the stud 26 and the lip 56 formed in the first member 32.

FIG. 6 shows the corner structure of a building with a stud 26 fitted into a last notch 68 in the first member 32. The stud 26 is positioned in the notch 68 so that a side surface 70 of the stud 26 is aligned with the end of the magic rail 24. The sheet of siding material 34 extends beyond the side surface 70 of the stud 26 and the front of the building by an amount equal to the thickness of the front wall siding material 74. Thus, the side wall siding material 34 and the front wall siding material 74 cooperate to form a closed corner of the building 10.

Although the invention has been described in detail with reference to a certain preferred embodiment, variations and modifications exist within the scope and spirit of the invention as described and defined in the following claims.

We claim:

1. A building structure comprising:

a floor section;

a plurality of side walls;

a front and back wall;

a roof section having a first angled upper hip portion, a lower angled portion and rafters supporting the upper portion;

the side walls attached to said floor section and to said rafters and comprised of vertical studs and siding attached to said floor section and to said rafters, the side wall also comprising a magic rail at its upper end;

the magic rail having a plurality of vertical notches opening in a first direction that receive and secure tops of the vertical studs to the magic rail;

the notches extending upwardly from a lower edge to an upper beveled edge of the magic rail and defining openings in said upper beveled edge;

said lower angled roof portion attached to an outer upper portion of said upper beveled edge of the magic rail without overlying the notch openings therein; and said rafters abutting a top of the studs and having a lower outside corner resting in an upper portion of the notches as in the magic rail and extending into the notch openings in the magic rail.

2. The building structure of claim 1 wherein there is a bottom template attached to the floor section with horizontal grooves cut therein; and wherein bottom ends of the studs are received in the horizontal grooves.

3. The building structure of claim 1 wherein the magic rail has a horizontally extending recess forming a lip spaced outwardly from the notches in a direction away from the first direction and wherein the siding attached to the studs extends into the recess between the studs and the lip.

4. The building structure of claim 2 wherein the magic rail has a horizontally extending recess forming a lip spaced outwardly from the notches in a direction away from the first direction and wherein the siding attached to the studs extends into the recess between the studs and the lip.

5. A kit for the assembly of a building structure comprising:

a floor section;

a plurality of side walls;

a front and back wall;

a roof section having a first angled upper hip portion, a lower angled portion and rafters for supporting the upper portion;

the side walls attachable to said floor section and to said rafters;

the side wall also comprising a plurality of vertical studs and a siding attachable to the floor section, and a magic rail to be positioned at an upper end of said studs and said siding;

the magic rail having a plurality of vertical notches opening in a first direction for receiving and securing tops of the vertical studs and a lower outer corner of the rafter to the magic rail;

the notches extending upwardly from a lower edge to an upper beveled edge of the magic rail and defining openings in said upper beveled edge;

said lower angled roof portion having a lower edge for attachment at an outer portion of said upper beveled edge of said magic rail without overlying the notch openings therein; and said rafters having a lower edge for abutting a top of the studs and having said lower outside corner for resting in an upper portion of the notch in the magic rail and for extending into the notch opening in the magic rail.

6. The building structure of claim 5 wherein their is a bottom template for attachment to the floor section and having horizontal grooves cut therein; and wherein bottom ends of the studs are receivable in the horizontal grooves.

7. The building structure of claim 5 wherein the magic rail has a horizontally extending recess forming a lip spaced outwardly from the notches in a direction away from the first direction to provide a resting place for the siding that is attached to the studs.

8. The building structure of claim 6 wherein the magic rail has a horizontally extending recess forming a lip spaced outwardly from the notches in a direction away from the first direction to provide a resting place for the siding that is attached to the studs.

* * * * *